US007488228B2

(12) United States Patent
Scott

(10) Patent No.: US 7,488,228 B2
(45) Date of Patent: Feb. 10, 2009

(54) KAYAK PADDLE

(76) Inventor: Richard A. Scott, 131 Stephanie Dr., Franklinville, NJ (US) 08322

( * ) Notice: Subject to any disclaimer, the term of this patent is extended or adjusted under 35 U.S.C. 154(b) by 0 days.

(21) Appl. No.: 11/786,081

(22) Filed: Apr. 10, 2007

(65) Prior Publication Data

US 2008/0254691 A1 Oct. 16, 2008

(51) Int. Cl.
*B63H 16/04* (2006.01)

(52) U.S. Cl. ..... 440/101

(58) Field of Classification Search ..... 441/56, 441/64; 440/101; 416/74
See application file for complete search history.

(56) References Cited

U.S. PATENT DOCUMENTS 3,422,470 A * 1/1969 Mares ..... 441/64
4,820,216 A * 4/1989 Masters ..... 440/101
6,991,501 B2 * 1/2006 Wilce ..... 440/101

* cited by examiner

*Primary Examiner*—Stephen Avila

(57) ABSTRACT

A kayak paddle for increasing paddle stroke efficiency and for improving comfort in paddle handling has a pronounced bent blade to length design of the paddle blade, as compared with prior paddle blades. The paddle has two blades, one blade secured at its top end to each end of a paddle shaft with a longitudinal axis. The bottom end of each blade extends forward of and above the longitudinal axis of the shaft, such that the chord line between the bottom end and top end of the blade intersects the longitudinal axis. The blade's length to radius of its arc is greater than 12 to 1. Through slots can be provided in the blades for stabilization and to minimize flutter. In addition, the paddle shaft is ergonomically shaped to fit the user's hand.

2 Claims, 8 Drawing Sheets

KAYAK PADDLE

BACKGROUND OF THE INVENTION

There has been a great deal of technological developments in the water sport/boating industry centered around the use of different and even exotic materials ranging from plastic to carbon graphite, in the manufacture of kayak paddles. However, little attention has been paid to the actual design of kayak paddles. The same basic paddle shaft and blade design continue to be manufactured and used by kayakers. Some attempts have been made to "sell" the public on the "bent shaft" design, and the recent "wing" blade design is recommended for "special use" by "advanced" kayakers (e.g., Olympic-level whitewater kayaking competition). However, limited effort has been expended in developing a more functionally engineered, ergonomic design of the shaft and the blade for the average and aging kayaker. There has been little done to advance the "touring paddle" design, so as to improve the efficiency of the basic paddle stroke for this class of user "touring" his or her kayak across a body of water. As a result, current kayak touring paddle designs have progressed little from the age old paddle configuration.

SUMMARY OF THE INVENTION

It is the object of the present invention generally to provide a kayak paddle which increases paddle stroke efficiency, improves comfort in handling the paddle shaft, and enhances the water removal feature of the paddle blade, thus elevating the overall kayaking experience beyond that which is currently available.

Specifically, the present invention provides for a pronounced bent blade to length design of the paddle blade, as compared with prior paddle blades. The paddle has two blades, one blade secured at its top end to each end of a paddle shaft with a longitudinal axis. The bottom end of each blade extends forward of and above the longitudinal axis of the shaft, such that the chord line between the bottom end and top end of the blade intersects the longitudinal axis. The blade's length to radius of its arc is greater than 12 to 1. Through slots can be provided in the blades for stabilization and to minimize flutter. In addition, the paddle shaft is ergonomically shaped to fit the user's hand.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
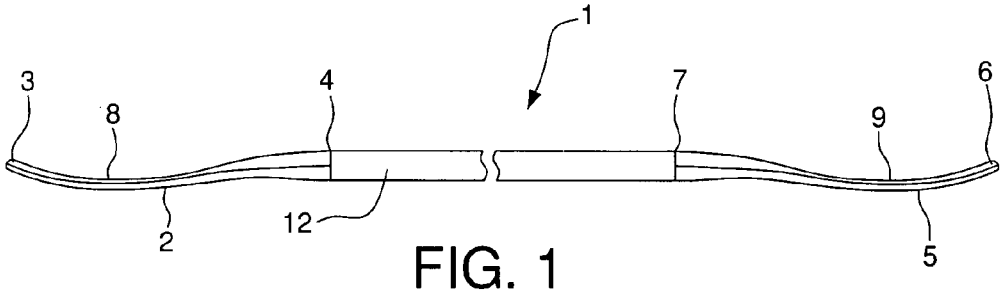
FIG. 1 (Prior Art)
FIG. 1 is an elevation view of a typical prior kayak paddle.
Figure 2:
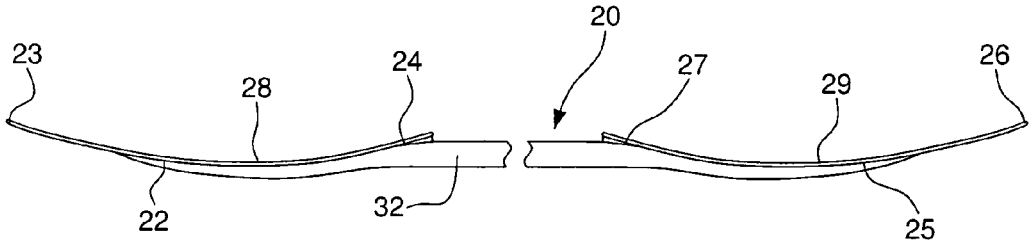
FIG. 2 is an elevation view of the kayak paddle of the present invention.
Figure 3:
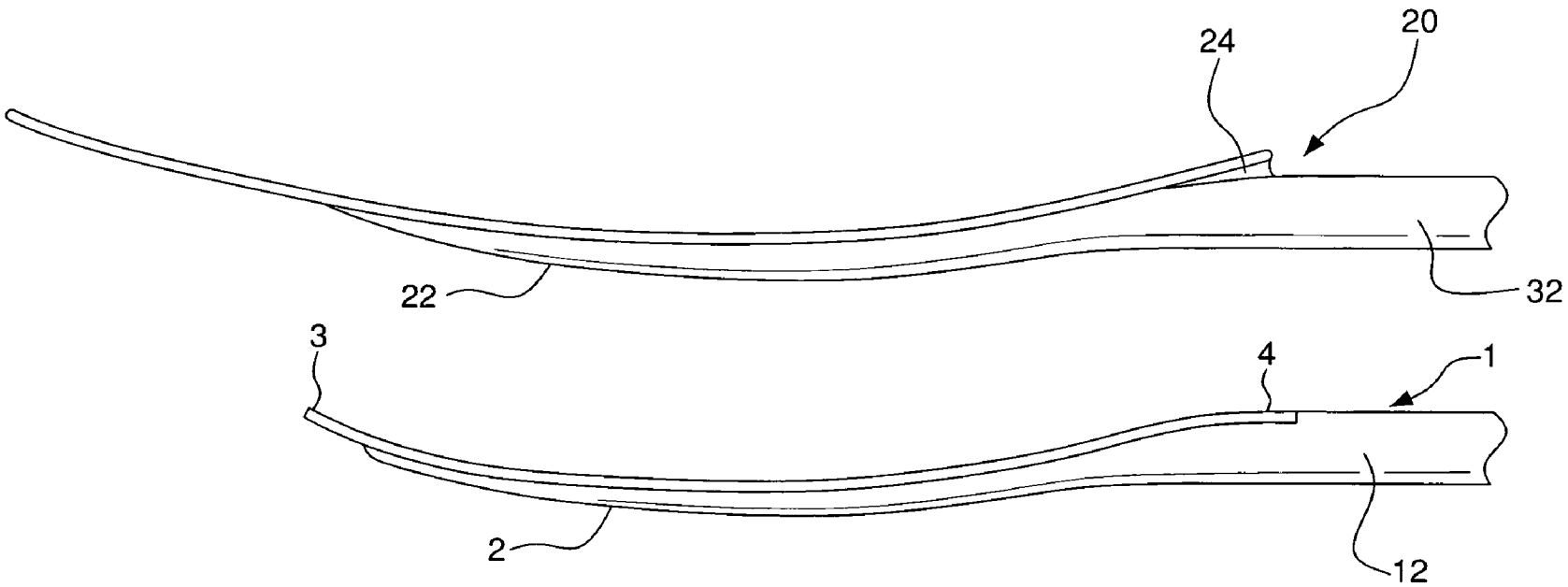
FIG. 3 shows elevation views of the kayak paddle blade of the present invention, compared to a paddle blade of a typical prior kayak paddle.
Figure 4:
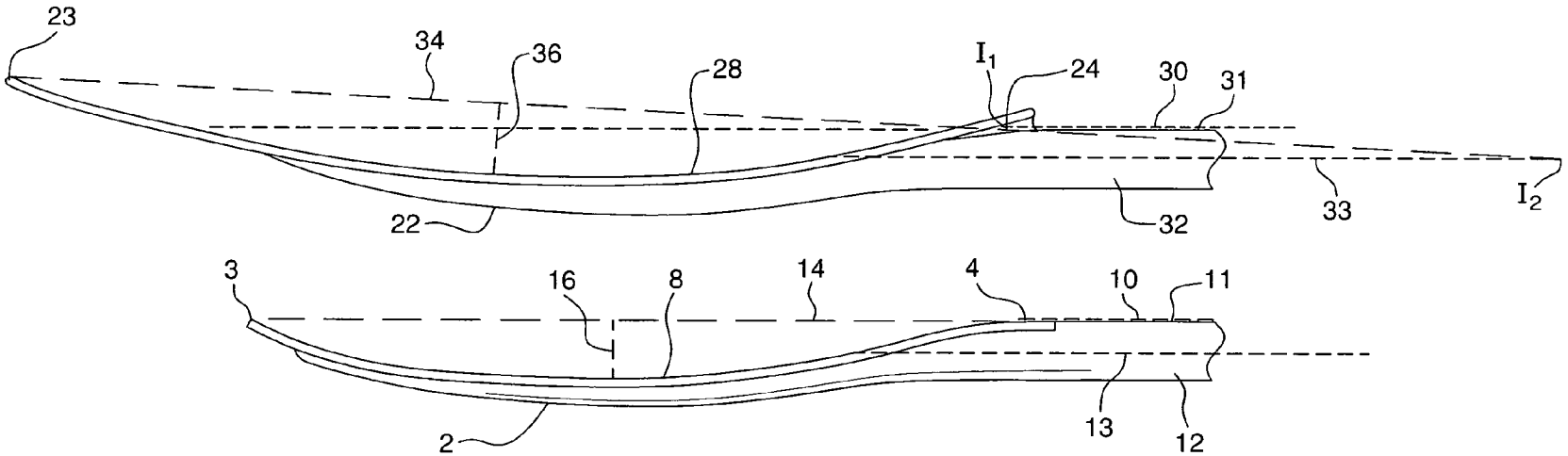
FIG. 4 shows the elevation views of FIG. 3, with design reference lines.
Figure 5:
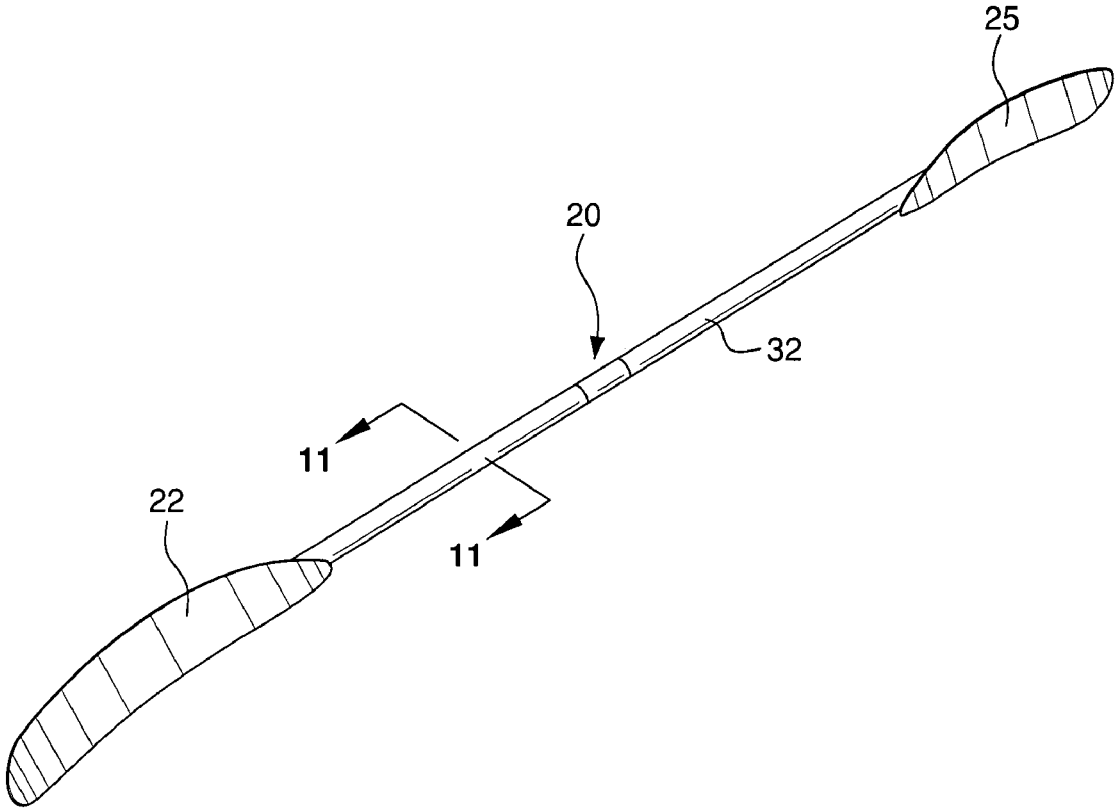
FIG. 5 is an isometric view of the kayak paddle of the present invention.

The distinctiveness of the kayak paddle of the present invention can readily be seen by comparing it to a typical prior art paddle. FIGS. 1, 3, and 4 show prior art paddle 1 and FIGS. 2-4 show paddle 20 of the present invention. Paddle blades 2 and 5 of prior art paddle 1 have paddle top ends 4 and 7 and bottom ends 3 and 6, respectively. Curved arc 8 formed between bottom end 3 and top end 4 and curve arc 9 formed between bottom end 6 and top end 7 have relatively small radii of curvature. For example, typically blades have lengths of between 16 inches and 18 inches and radii of curvatures ranging from 0 inches, for flat blades, to 1.5 inches. Blade 2, with a radius of curvature 16, shown in FIG. 4, exemplifies a prior art blade with a large radius of curvature. Most prior paddle blades have far less of an arc. Thus the maximum blade length to radius of curvature ratio of existing kayak blades, including blade 2 seen in FIG. 4, is no greater than 12 to 1.

With particular reference to FIG. 4, in which only blade 2 of paddle 1 is shown, it is also evident that bottom end 3 and top end 4 lie in a transverse plane which is congruent with longitudinal surface 10 of forward face 11 of shaft 12 and which is parallel to longitudinal axis 13 of the shaft. Referenced another way, chord 14 of arc 8 of blade 2 is congruent with forward face longitudinal surface 10 of shaft 12 and parallel to longitudinal axis 13 of the shaft.

The paddle of the present invention 20 comprises paddle blades 22 and 25 with paddle top ends 24 and 27 and bottom ends 23 and 26, respectively. Blades 22 and 25 are rotated up on shaft 32 such that curved arc 28 formed between bottom end 23 and top end 24 and curved arc 29 formed between bottom end 26 and top end and 27 extend further beyond longitudinal surface 30 of facing edge 31 of the shaft, thus placing bottom ends 23 and 26 of paddle blades 22 and 25 further out in front of shaft 32. Arcs 28 and 29 each have a forward, concave face.

With particular reference to FIG. 4, in which only blade 22 is shown, by rotating the blade to form arc 28, bottom end 23 and top end 24 are located within a common transverse plane which intersects longitudinal surface 30 of facing edge 31 at $I_1$ and longitudinal axis 33 of shaft 32 at $I_2$ at acute angles below the transverse plane. Referencing this configuration another way, chord 34 of arc 28 of blade 22 intersects forward longitudinal surface 30 of facing edge 31 at $I_1$ at an acute angle below the chord and a continuation of the chord intersects longitudinal axis 33 of shaft 32 at $I_2$, also at an acute angle below the chord.

It is significant that the blade design can be either a concentric arc or a parabolic arc. The increased radius of the arc in the parabola can be located either at the bottom end of the paddle or at the top end. Performance parameters will dictate which option is optimum for a particular application.

The present invention also contemplates employing an increased transverse paddle blade length to approximately 20 inches, measured from top end 24 to bottom end 23. This distance is also the length of chord 34 of arc 28. It is further anticipated that the radius of curvature 36 of arc 28 will be greater than 1.5 inches. The increased paddle length, combined with the outward rotation of the blade and higher radius of curvature, results in a blade length to radius of curvature greater than 12 to 1. This configuration of the present invention significantly enhances the performance efficiency of the kayak paddle through the water in a number of respects.

Figure 6:
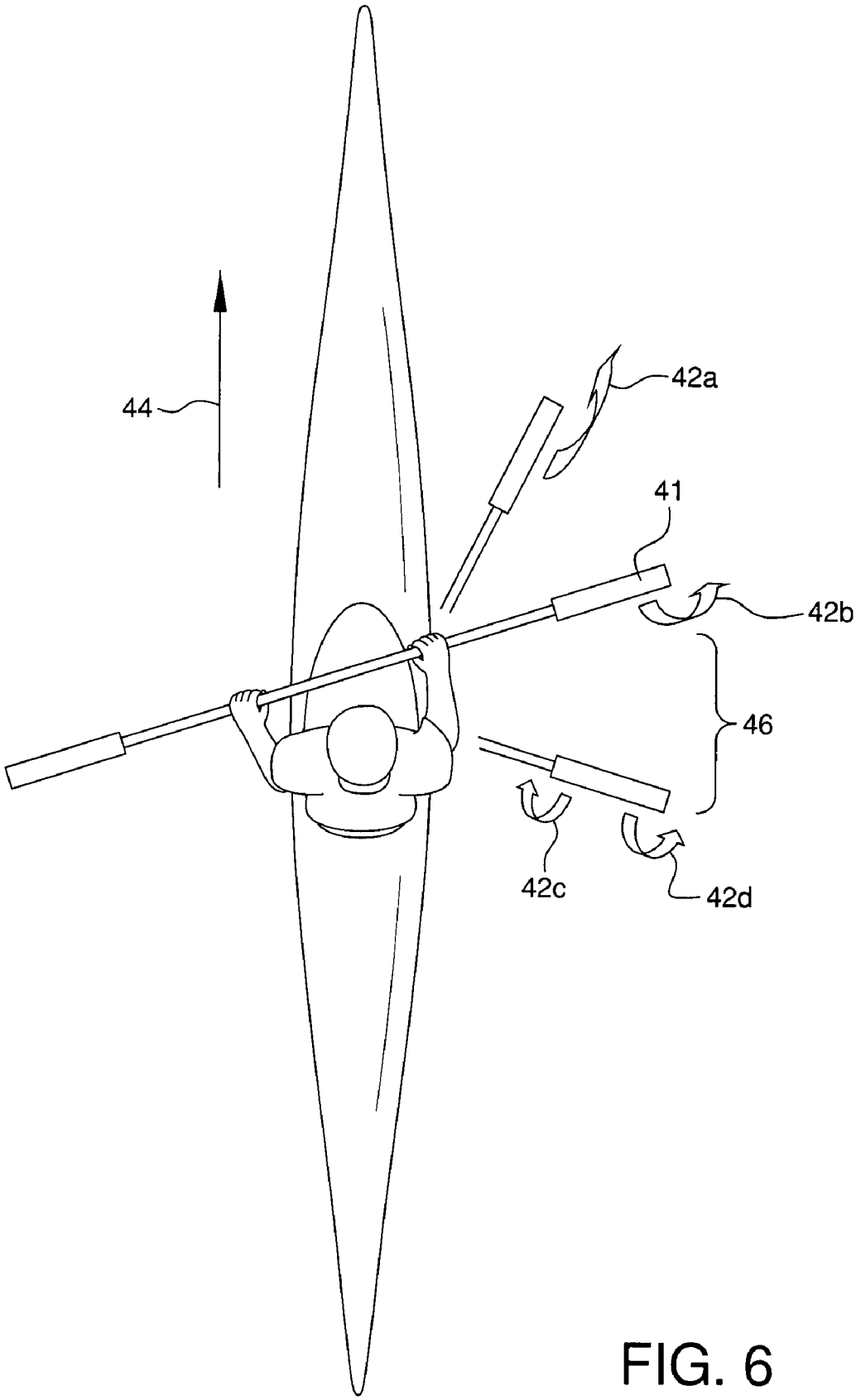
FIG. 6 shows sequence of water flow off a typical prior kayak paddle.

As shown in FIG. 6, a flat paddle 41 or a paddle with a very small radius of curvature allows water to "roll-off" its surface as the face of the paddle changes direction relative to the kayak's intended direction of travel 44. This water roll off results in a reduction of water pressure on the blade, causing a shorter direction of paddle stroke efficiency 46. This can only be overcome by paddling faster and pulling harder, which leads to paddler fatigue.

Figure 7:
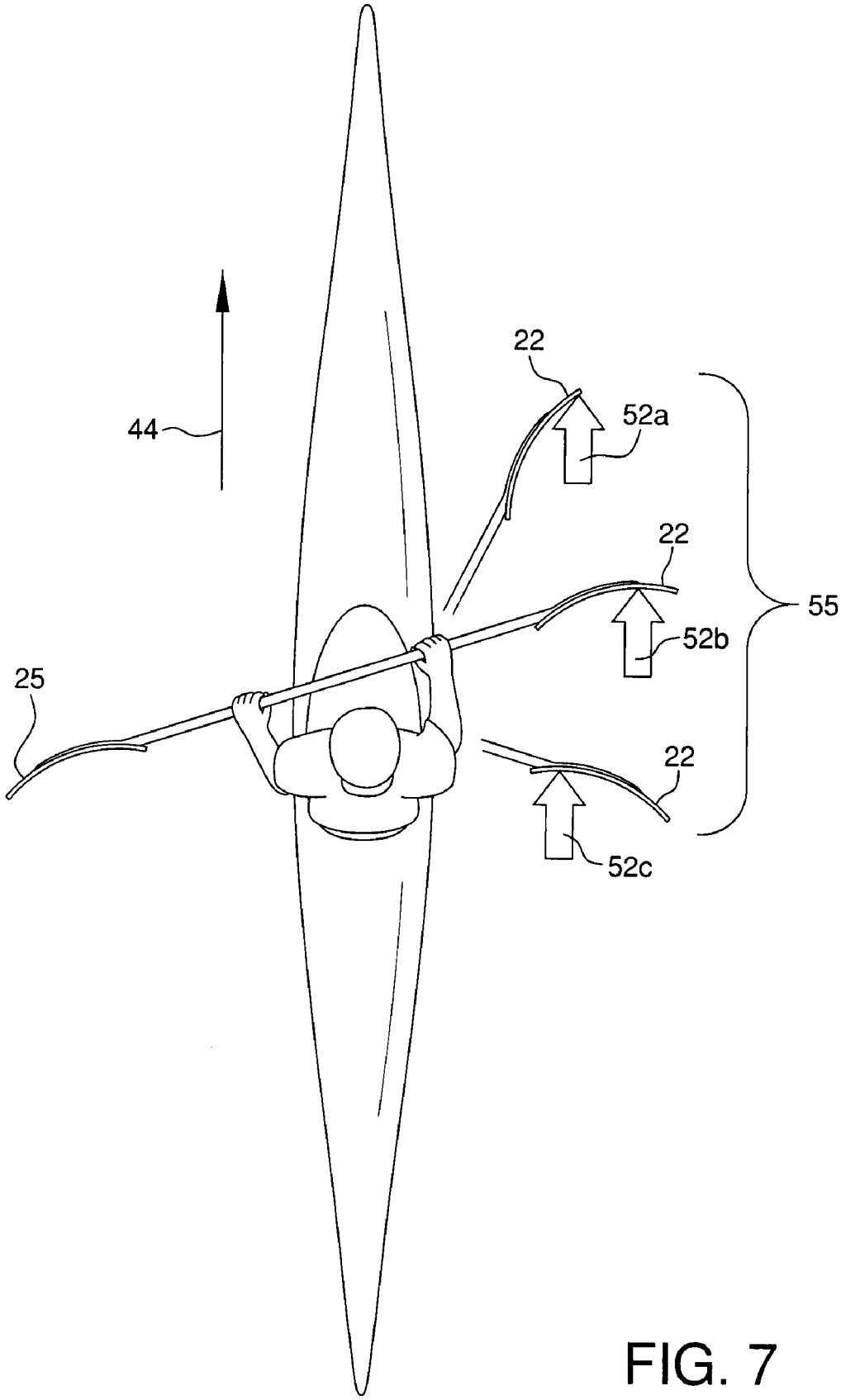
FIG. 7 shows sequence of water flow off the kayak paddle of the present invention.
Figure 8:
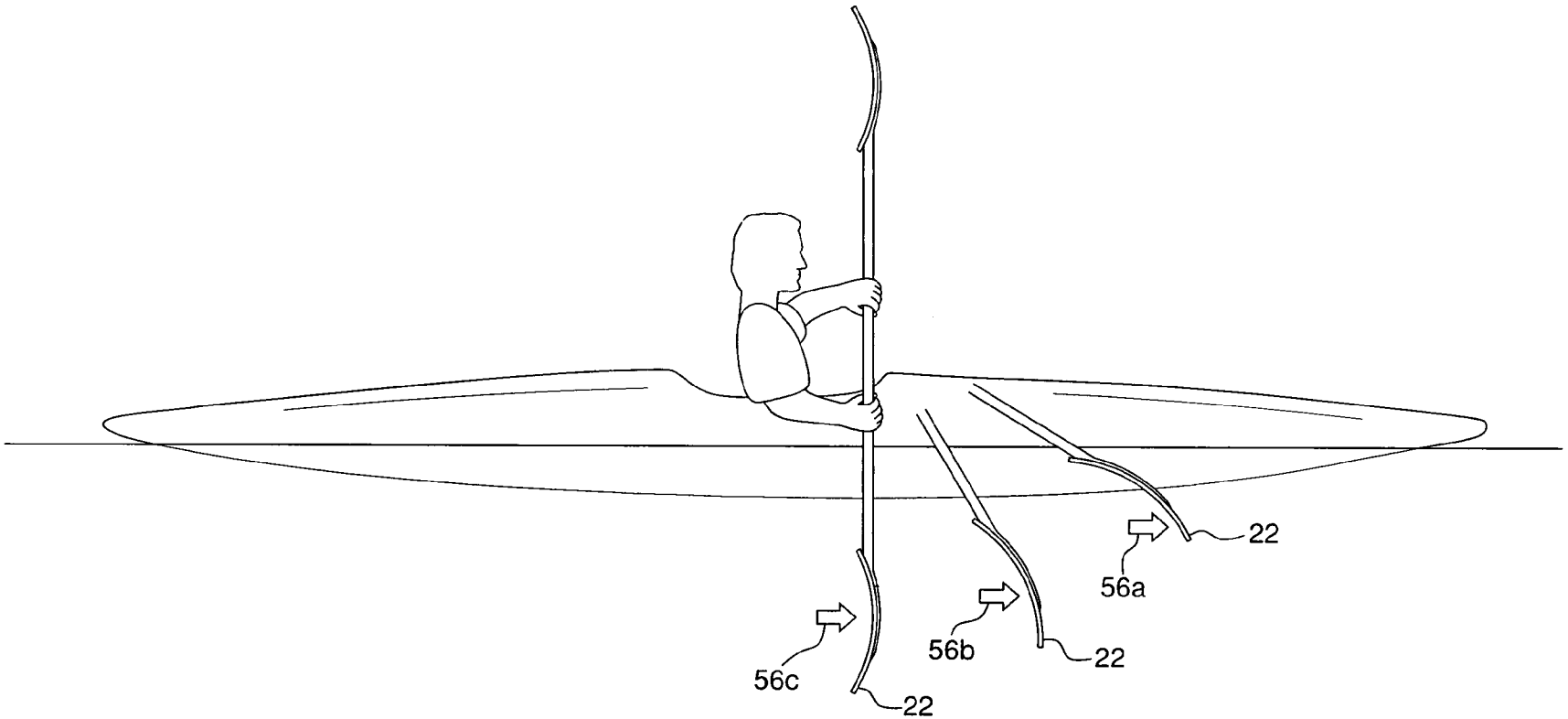
FIG. 8 shows sequence of water flow angle to blade of the kayak paddle of the present invention.

On the other hand, as shown in FIG. 7, the increased angle of blades 22 and 25 of the invention maintains water volume 52*a*-52*c* on the blade longer throughout the stroke. This allows for a longer, maximum length of paddle stroke efficiency 55. In addition, as seen in FIGS. 7 and 8, a more radically curved blade allows a portion of the blade to remain perpendicular to the direction of the stroke throughout the stroke, thereby creating a greater resistance force 56*a*-56*c* on the paddle, thus moving the kayak forward at a higher level of performance for the effort expended.

Figure 9:
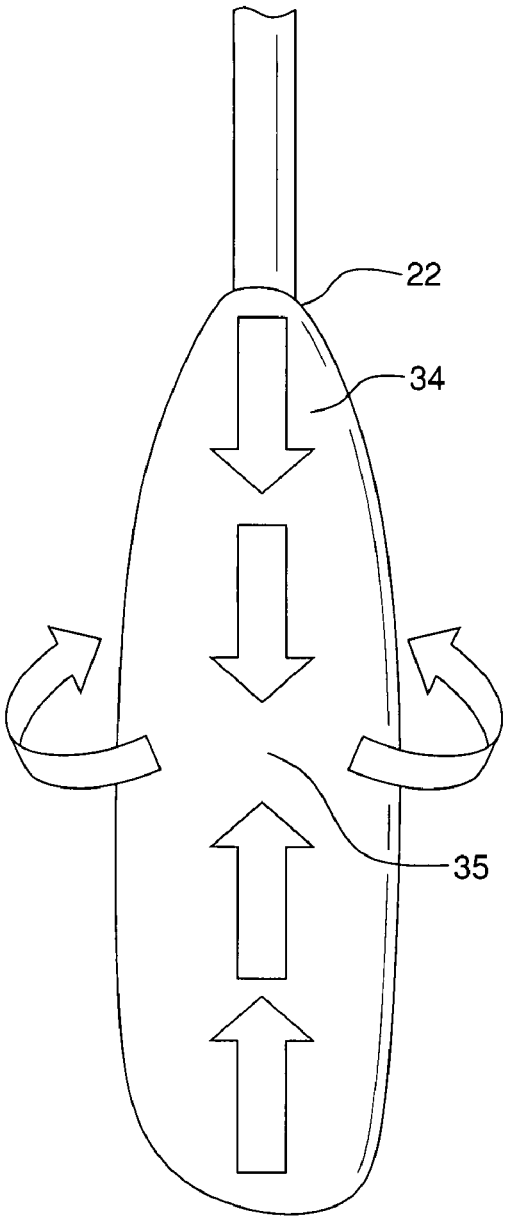
FIG. 9 is a view of the kayak paddle blade of the present invention, showing water flow off the face of the blade.

FIG. 9 shows face 34 of paddle blade 22 of the invention and how the curvature of the blade re-directs water towards its center 35. The longitudinal curve of the blade directs the water back onto itself, maximizing the amount of time the water stays in contact with the blade. Simultaneously, that same arc allows the water to "bleed off" the blade in a uniform fashion equally to both sides at the valley of the blade's arc, thus minimizing or preventing the phenomenon known as "flutter", the back-and-forth movement of the paddle perpendicular to the direction of the stroke. Flutter is annoying, reduces the effectiveness of the stroke, and can ultimately cause the paddler to tire over the course of a long day on the water.

Figure 10:
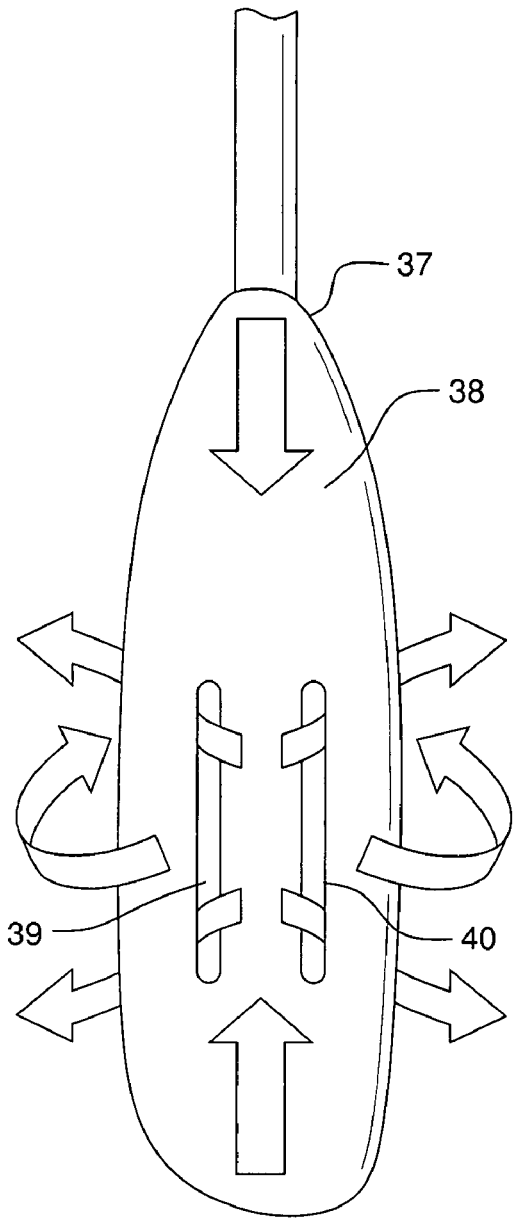
FIG. 10 is a view of another embodiment of the kayak paddle blade of the present invention, showing the reduction and redirection of water flow off the face of the blade.

FIG. 10 shows another embodiment of the invention. Paddle blade 37 has face 38 and through slots 39 and 40. Water flow over face 38 of blade 37 is redirected in the same manner as has been described for blade 22 in FIG. 9, except that stability is further enhanced and paddle flutter minimized since slots 39 and 40 allow surface water to bleed through the slots.

FIGS. 9 and 10 also show the shape of faces 34 and 38 of paddles 22 and 37 of the present invention. Faces 34 and 38 are contoured in shape and are tapered from bottom end to top end.

An additional benefit of the increased blade arc feature of the invention is that the tip of the blade is more perpendicular to the water upon its entry into the water. This makes the paddle's entry into the water very quiet, an attribute that is highly regarded by people who are out to enjoy nature without disturbing it. Also, a day of paddling involves thousands of strokes by the paddler, further accentuating the desire for a quiet and efficient paddle.

It has also been observed that as paddle 20 is pulled through the water, a wake-effect occurs around the edges of the paddle. This wake indicates that there is a current of water which is created by the paddle as it is pulled through the water. The wake curls around the edge of the paddle and continues to curl around to its back side. The effect is not unlike the rotation of water in a natural wave, or the rotation of air caused by the wake turbulence of an aircraft wing. This turbulence is also reminiscent of the airflow across the spoiler at the rear of a race car, creating a high pressure flow off the spoiler (face of the paddle blade) which rotates into the lower pressured area behind the race car (back side of the paddle blade). Thus it does not seem unreasonable to presume that the high pressure water coming off of the front of the paddle blades rotates into the low pressure area behind the blades and actually helps to push the paddle blades through the water. This occurs due to the blade attributes previously discussed with regard to FIGS. 7-10.

Paddle 20 of the present invention clearly enhances the paddling efficiency of its user. For example, the paddle stroke moves the paddle blade in essentially an arc emanating from the power of the kayaker's torso which is transferred through his/her shoulder, continuing down his/her arm, down the paddle shaft and culminating at the paddle blade.

With a paddle held level with the surface of the water being at a lateral azimuth of zero degrees (0°), the typical kayaker will perform the paddle stroke with the paddle held between thirty degrees (30°) to eighty degrees (80°) from level while moving the paddle blade through the water, beginning at the surface in front and to one side of the paddler, continuing with the paddle being submerged ever deeper as it is pulled toward the mid-point of the stroke, and then moving ever shallower as it continues toward the end of the stroke. The stroke ends at the surface on the same side of the paddler and either next to or slightly behind the kayaker. This stroke creates an ever-changing angle with which the paddle blade is moving through the water relative to the intended direction of travel of the kayak. Due to these constantly changing angles, a flat or relatively flat paddle begins the stroke highly inefficiently as water slides off of the face of the paddle blade which is facing down and away from the kayaker and approximately forty-five (45°) from the intended direction of the kayak. See FIG. 6.

The efficiency of the flat paddle slowly improves as the blade approaches the point at which it is approximately perpendicular to the kayak, at which point it reaches maximum effectiveness 46 for a very short period of time. This is the point at which it is recommended that a kayaker remove the paddle from the water and begin the same process on the other side of the kayak. Thus, a paddle with a flat or relatively flat face is highly inefficient, causing the kayaker to stroke at a higher rate of speed and pull harder on the paddle at the expense of a larger energy output in order to attain even a modest amount of forward momentum. A paddle with a flat or relatively flat face combined with the dihedral design, used to bleed water from the blade to minimize flutter, is even less efficient.

The paddle of the subject invention, being radically curved along its length and flat across its width, allows the face of the paddle to be pushing more directly into the water, and even "funneling" water back into the center of the blade throughout the entire length of the stroke. As previously described with referenced to FIGS. 7 and 8, after maximizing the resistance against the water, water bleeds out of the sides at the center of the blade to reduce or eliminate flutter. This results in a powerful, efficient stroke which maximizes the forward thrust of the kayak while optimally utilizing the effort of the kayaker. This exceedingly smooth stroke means the kayaker can cruise along using lighter pull-pressure on the paddle and still have the reserve power, by pulling harder, to paddle against a strong resistance, e.g. a headwind and/or waves, when necessary.

Figure 11:
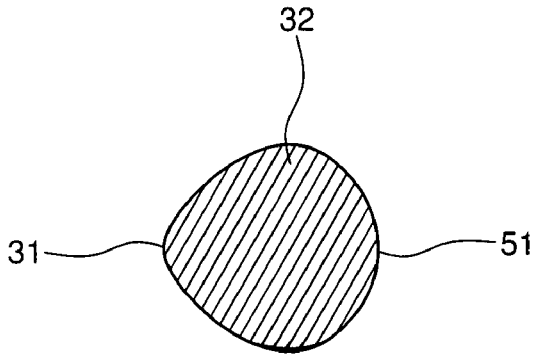
FIG. 11 is a cross-sectional view of the kayak paddle shaft of the present invention, taken from FIG. 5.

The section of the shaft where the kayaker will typically be placing his/her hands is commonly shaped in either a round or an oval configuration. In order to better match the ergonomic shape of the human hand, this section of shaft 32, as seen in FIG. 11, has a tapered, cross-sectional contour, formed in the shape of a "teardrop", with the larger side on back edge 51 of the shaft, and the more pointed side on facing edge 31 of the shaft. This design helps to minimize stress and reduce fatigue, while making the shaft more comfortable to hold.

Paddle blade strength is obtained through the use of bent wood strips and multiple waterproof glue joints. This eliminates the need for relying upon the application and use of a strength reinforcement coating, such as fiberglass cloth, onto the surface of the blade. The manufacture of a custom design wooden paddle allows for a multitude of material options. The material used in the wooden paddle is an intelligent and strategic blend of both hardwood and softwood, optimizing both the strength and the reduced-weight characteristics to achieve a product balanced in both categories. For uses in severe environments requiring exceptional paddle blade strength, the application of a reinforcing coating may be warranted.

Wood blades are generally made of wood strips from a variety of wood species. The strips range in thickness from approximately ⅛ inch to approximately ¼ inch. The thickness of the blade material can be changed based upon: 1) the type of wood used; 2) the use of a blade strengthening coating (fiberglass); 3) or the use of a blade material other than wood which can allow for a variation in thickness in order to obtain the required blade strength.

While bent wood is the material of choice for the manufacture of the paddle of the present invention, the invention is not to be considered limited to the use of this or other suitable material. The paddle may be made out of other conventional materials known in the art such as fiberglass, carbon graphite, plastics, stainless steel, and other lightweight metals.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A kayak paddle comprising:

a shaft with a longitudinal axis, a facing edge and a back edge, and a first end and a second end;

first and second paddle blades, each blade having a top end connected to the facing edge of the shaft and a bottom end which extends forward of and above the longitudinal axis of the shaft, each of said first and second paddle blades having a transverse length and a chord extending from the top end to the bottom end) the top end and bottom end of each paddle being located in a common transverse plane, and the intersection of the transverse plane and longitudinal axis forming an acute angle below the transverse plane, the first and second paddle blades each further having an arc with a radius of curvature extending from the arc to the chord, the ratio of blade transverse length to blade arc radius of curvature being greater than 12 to 1 and less than 90 to 1, the blades are flexible and in response to water pressure applied at the force of a stroke through the water, the blades bend from an arc shape to a parabolic form to maintain blade stability though out the stroke and improve the overall performance of the blade.

2. The kayak paddle as in claim 1 wherein the shaft has a tapered cross-sectional contour.

* * * * *